US011058153B2

(12) United States Patent
Arnel et al.

(10) Patent No.: US 11,058,153 B2
(45) Date of Patent: Jul. 13, 2021

(54) WEARABLE ELECTRONIC SIMULATED SMOKING DEVICE

(71) Applicants: Scott M. Arnel, Oyster Bay, NY (US); Eric Schmiesing, Syosset, NY (US)

(72) Inventors: Scott M. Arnel, Oyster Bay, NY (US); Eric Schmiesing, Syosset, NY (US)

( * ) Notice: Subject to any disclaimer, the term of this patent is extended or adjusted under 35 U.S.C. 154(b) by 757 days.

(21) Appl. No.: 15/806,744

(22) Filed: Nov. 8, 2017

(65) Prior Publication Data

US 2018/0064167 A1 Mar. 8, 2018

Related U.S. Application Data

(63) Continuation of application No. 14/223,421, filed on Mar. 24, 2014, now Pat. No. 9,820,508.

(51) Int. Cl.

| | |
|---|---|
| ***A24F 47/00*** | (2020.01) |
| ***A24F 40/485*** | (2020.01) |
| ***A44C 9/00*** | (2006.01) |
| ***A44C 5/00*** | (2006.01) |
| ***A45F 5/00*** | (2006.01) |
| *A24F 40/10* | (2020.01) |

(52) U.S. Cl.

CPC ..... *A24F 40/485* (2020.01); *A44C 5/0007* (2013.01); *A44C 9/0053* (2013.01); *A45F 5/00* (2013.01); *A24F 40/10* (2020.01); *A45F 2005/008* (2013.01)

(58) Field of Classification Search

CPC ..... A24F 40/00; A24F 40/40; A24F 40/46; A24F 47/002; A24F 47/008; A45F 5/00; A45F 2005/008; A44C 5/0007; A44C 9/0053

See application file for complete search history.

(56) References Cited

U.S. PATENT DOCUMENTS

| | | | | |
|---|---|---|---|---|
| 4,265,236 | A * | 5/1981 | Pacella | A61M 15/08 128/202.13 |
| 5,819,756 | A | 10/1998 | Mielordt | |
| 2004/0031488 | A1* | 2/2004 | Terada | A61M 11/005 128/203.15 |
| 2010/0163027 | A1* | 7/2010 | Hyde | A61M 15/08 128/203.12 |
| 2012/0138637 | A1* | 6/2012 | Ciavarella | A61L 2/18 222/175 |
| 2012/0234315 | A1* | 9/2012 | Li | A61M 15/06 128/200.21 |

FOREIGN PATENT DOCUMENTS

| | | | |
|---|---|---|---|
| DE | 2642476 | A1 | 3/1978 |
| KR | 20120089546 | A | 8/2012 |
| WO | 2016033733 | A1 | 3/2016 |

* cited by examiner

*Primary Examiner* — Michael H. Wilson
*Assistant Examiner* — Dionne W. Mayes
(74) *Attorney, Agent, or Firm* — Rosenberg, Klein & Lee

(57) ABSTRACT

A wearable electronic simulated smoking device is provided for delivery of a desired active ingredient responsive to a user's inhalation through the device. The device includes an elongated tubular member (110) having at least one reversibly bendable portion to at least partially encompass a portion of a user's body and is releasably retainable thereat. The device includes a vaporization chamber supplied with a vaporizable smoking composition and enabled by a controller to generate vapor from the vaporizable smoking composition and add the vapor to air drawn through the device.

25 Claims, 9 Drawing Sheets

WEARABLE ELECTRONIC SIMULATED SMOKING DEVICE

CROSS REFERENCE TO RELATED APPLICATIONS

This application is a continuation application of U.S. patent application Ser. No. 14/223,421, entitled "WEARABLE ELECTRONIC SIMULATED SMOKING DEVICE", filed on 24 Mar. 2014, currently pending.

BACKGROUND OF THE INVENTION

This disclosure directs itself to a wearable electronic simulated smoking device that provides convenient storage and use as an alternative to inhalation of the smoke from burning a composition containing a desired active ingredient. More in particular, the disclosure is directed to a wearable electronic simulated smoking device that includes a tubular body that is configured to at least partially encompass a portion of a user's body and thereby be easily transported by the user. Still further, the disclosure is directed to a wearable electronic simulated smoking device where the tubular body has at least a portion thereof which is reversibly bendable into, or out of, an arcuate contour. Further, the tubular body may include at least one portion having a fixed contour as well as at least one portion that is reversibly bendable.

Electronic simulated smoking devices, commonly known as e-cigarettes or e-cigs, came into being in the early 1960's. These simulated smoking devices have grown in acceptance and popularity because it is believed that they are less toxic to the user than the conventional method of inhaling a desired active ingredient through burning a source of that ingredient and inhaling the products of that combustion, including carcinogens. Without the toxic products of combustion being present, there is a greatly reduced concern about "secondhand smoke," as well. They have also grown in popularity due to people's fascination with gadgetry.

Nevertheless, there has not been a new or fashionable way of transporting or storing these devices on one's person. They are often carried loose or in cases that are put in a user's pocket or handbag. Unlike a conventional cigarette, cigar or pipe that typically and most easily is ignited and burned until the substance carrying the active ingredient is substantially consumed, the e-cigarette can be used intermittently. The e-cigarette is inactive whenever no inhalations are being made through the device and can be stored on the user's person. Thus, there is a need for a more convenient storage and transport mechanism for electronic simulated smoking devices.

SUMMARY OF THE INVENTION

A wearable electronic simulated smoking device is provided that includes an elongated tubular body having at least a portion thereof that is reversibly bendable for the tubular body to form an arcuate shape at least partially encompassing a portion of a user's body. The tubular body has an air inlet formed therein, a suction opening, and a fluid flow path therebetween. Further, the smoking device includes a vaporization chamber disposed in the tubular body for vaporizing a vaporizable smoking composition. The vaporization chamber is in communication with the fluid flow path. Further, the smoking device includes a controller coupled to the vaporization chamber for activating the vaporization chamber to generate vapor from the vaporizable smoking composition and add the vapor to air drawn through the fluid flow path. The smoking device still further includes a power supply coupled to the controller.

From another aspect, a wearable electronic simulated smoking device is provided that includes an elongated tubular body that is reversibly bendable into an arcuate shape at least partially encompassing a portion of a user's body. The tubular body has an air inlet formed therein, a suction opening, and a fluid flow path therebetween. The smoking device further includes a vaporization chamber disposed in the tubular body for vaporizing a vaporizable smoking composition, and the vaporization chamber is in communication with the fluid flow path. Further, the smoking device includes a controller coupled to the vaporization chamber for activating the vaporization chamber to generate vapor from the vaporizable smoking composition and add the vapor to air drawn through the fluid flow path. The smoking device still further includes a power supply coupled to the controller.

DETAILED DESCRIPTION OF THE PREFERRED EMBODIMENTS

Referring to FIGS. 1-12, there is shown a wearable electronic simulated smoking device 100, 100', 100" for convenient storage and use as an alternative to inhalation of the smoke from burning a composition containing a desired active ingredient. Wearable electronic simulated smoking device 100, 100', 100" includes a unique housing in the form of a tubular body 110 that is configured to at least partially encompass a portion of a user's body and thereby be easily transported by the user. While being worn, wearable electronic simulated smoking device 100, 100', 100", in some instances, can be used to deliver a desired active ingredient through inhalation by the user through that device.

Figure 2:
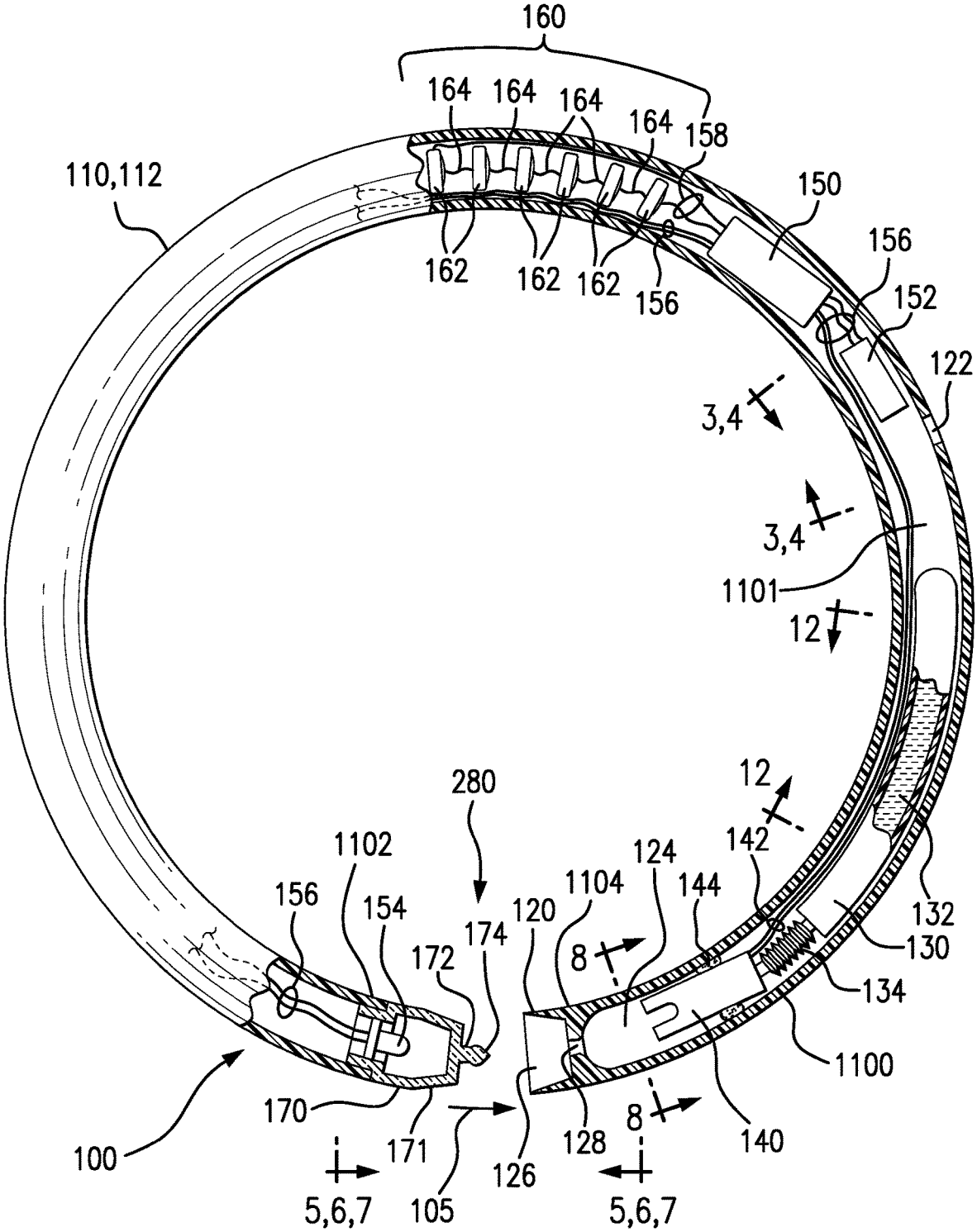
FIG. 2 is a schematic illustration, partially cut-away, of another configuration of the present invention in a bent contour.
Figure 2A:
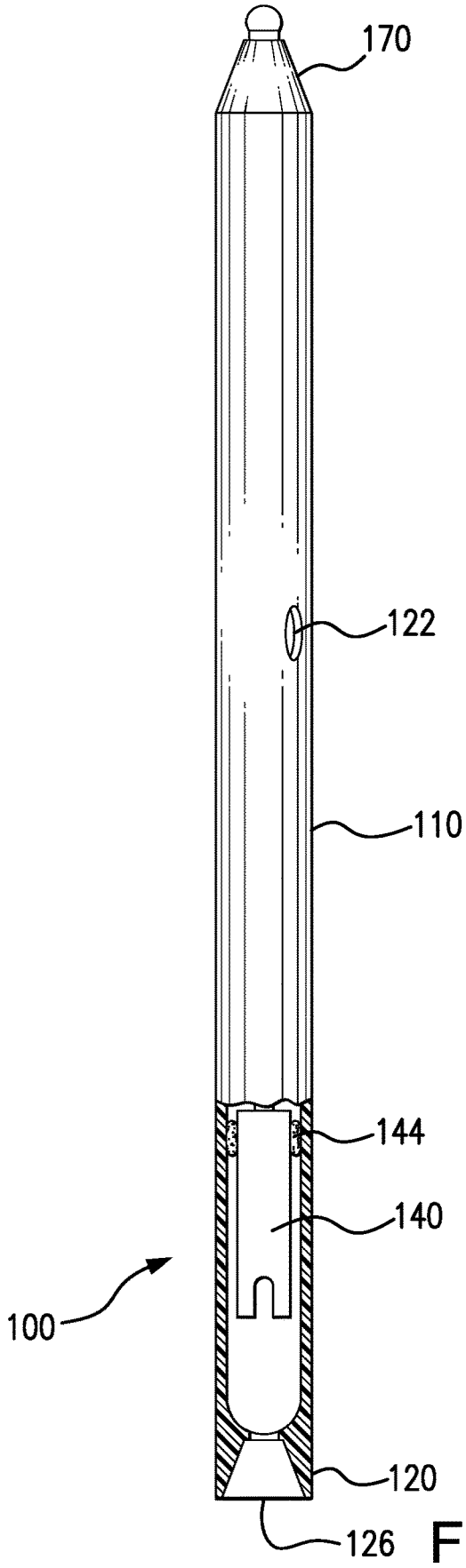
FIG. 2A is an illustration of the configuration shown in FIG. 2 in a straightened contour.

Referring now to FIGS. 2 and 2A, there is shown schematic illustrations of a wearable electronic simulated smoking device 100. Wearable electronic simulated smoking device 100 includes an elongated tubular housing 110, a portion of which 112 is reversibly bendable into, or out of, an arcuate contour. In the particular configuration shown, the bendable portion 112 is defined by substantially the entire extent of the tubular body 110. As will be described in following paragraphs, the bendable portion 112 of tubular body 110 may be formed of various plastic or metallic materials having properties and/or structural arrangements providing the necessary pliancy to be reversibly bendable, either elastically or inelastically.

FIG. 2A illustrates the wearable electronic simulated smoking device 100 arranged for use. The tubular body 110 is straightened longitudinally from its arcuate storage configuration shown in FIG. 2, allowing a user to easily access the mouthpiece portion 120. The user can then inhale through the suction opening 126 to obtain delivery of a liquid smoking composition in the form of an aerosol or vapor carried by air drawn into the tubular body through the air inlet opening 122. Each time a user inhales through the suction opening 126, the light transmissive end cap 170 is illuminated in correspondence therewith.

The operation of wearable electronic simulated smoking device 100 is best understood by referring back to FIG. 2. Wearable electronic simulated smoking device 100 includes a hollow tubular body 110 housing the components that store a smoking liquid composition 132 and provide the means to deliver the composition 132 to the air inhaled through the device by the user. The components that are combined to form an electronic simulated smoking device, commonly referred to as an e-cig or e-cigarette, are well known in the art and thus their particular structures will not be described in detail, other than where modifications have been incorporated therein to accommodate the bendability of the tubular body 110 or portions thereof.

Wearable electronic simulated smoking device 100 includes a supply of a smoking liquid composition 132 within a fluid container 130. The smoking liquid composition contains an active ingredient intended to be inhaled, such as a nicotine solution, a mixture of nicotine and flavorings and/or aromatic compositions, and where legally permitted, a tetrahydrocannabinol (THC) solution, a mixture of THC and flavorings and/or aromatic compositions, and combinations thereof, as examples. The supply of the smoking liquid composition 132 may be stored as liquid within fluid container 130 or absorbed in a porous material disposed in fluid container 130. Fluid container 130 is formed of a flexible plastic material so that it is able to conform to the contour of the internal bore 1101 of the bendable portion 112 of tubular body 110 when that portion is bent into an arcuate contour. The outer diameter of the fluid container 130 is sufficiently smaller than the inner diameter of internal bore 1101 so that air drawn therein through the air inlet opening 122 can pass by the fluid container. Alternately or in addition thereto, the wall of fluid container 130 may be formed with longitudinally extending air channels. The smoking liquid composition 132 is output to the nebulization chamber 140 through a flexible conduit 134. As is known in the art, the flow of the liquid smoking composition to or within the nebulization chamber is controlled by a valve (demand type or controlled by the controller 150) or through the use of a wick that supplies the liquid through capillary action on, for all practical purposes, a demand basis.

The flexible conduit 134 may be formed of a flexible material, such as silicone, polyvinyl chloride, nylon, neoprene, polyurethane, or natural and synthetic rubber, to name a few. More rigid materials can be made sufficiently flexible by constructing conduit 134 with an accordion or bellows type wall contour, as illustrated in FIG. 2. As an alternative to a single flexible fluid container 130, a segmented fluid container 130', shown in FIG. 12, may be substituted. Fluid container 130' consists of container sections 136 fluidly connected in series by respective flexible container conduits 138. Each flexible container conduit 138 may be formed of like materials and/or constructed as was described for flexible conduit 134, including provisions for allowing air to pass along the outer sides of the container walls.

As used herein, the term "nebulization" refers to a process for conversion of a liquid into a spray, aerosol, mist or vapor, by either atomization or vaporization mechanisms. Nebulization chamber 140 may be of the type that vaporizes the liquid smoking composition 132 supplied thereto through the use of an internal heating element, or the type that atomizes the liquid smoking composition 132 using an ultrasonic transducer, such as a piezoelectric transducer, to create an aerosol. Both types of nebulization chambers are well known in the electronic cigarette art and thus the internal structure and theory of operation are not being described herein. Nebulization chamber 140 is disposed in the internal bore 1101 of tubular body 110 and is sufficiently smaller in diameter than internal bore 1101 to be accommodated therein when such is disposed in an arcuate contour. As is typical for such devices, nebulization chamber 140 is provided with air inlet openings on a rear portion thereof (not shown) and the portion of internal bore 1101 in which nebulization chamber 140 is disposed is defined as the fluid flow path. Fluid flow path 124 extends from the air inlet opening 122, past the outer wall of the fluid container 130, 130', through the nebulization chamber 140 to the suction opening 126. An annular seal 144 encompasses the nebulization chamber 140 to block air from bypassing passage through nebulization chamber 140.

A controller 150 is provided to control the operation of the nebulization chamber 140 in response to inhalation by a user. Such controllers are commonly used in conventional e-cigarettes and may be in the form of a microprocessor or a digital, analog or hybrid system on chip (SOC). Controller 150 has an input coupled to a sensor 152 via a pair of the plurality electrical wires 156 connected to controller 150. The sensor 152 is located in fluid communication with the fluid flow path 124 for detecting a reduction in air pressure in fluid flow path 124, as an indication of a user drawing in air from the suction opening 126. Responsive to detection of the pressure drop, controller 150 energizes the nebulization chamber 140 through the electrical wires 142 to deliver the liquid smoking composition/air mixture to the user as the user inhales through the suction opening 126 of the mouthpiece 120. The mouthpiece 120 may be connected to the tubular body 110 or integrally formed therewith.

Responsive to the detection of a user's inhalation through the device 100, controller 150 energizes a light emitting diode (LED) 154 via another pair of the plurality electrical wires 156 connected to controller 150. LED 154 is disposed at the distal end 1102 of tubular body 110, but could be located at any desired location. End cap 170 is coupled to the distal end 1102 of tubular body 110 and is light transmissive to serve to both permit visualization of illumination from LED 154 and provide releasable coupling with the opposing proximal end 1104 of tubular body 110, to be further described in following paragraphs. The optical property of end cap 170 may range from transparent to varying levels of translucency. To enable the energization of the nebulization chamber 140 and LED 154, a power supply 160 is connected to controller 150 by means of a pair of wires 158. Power supply 160 is formed by a plurality of batteries or cells 162 that may be connected in series, parallel or a combination of series and parallel by means of one or more interconnection leads 164 (depending on the connection arrangement of the batteries). Each interconnection lead 164 is a flexible electrical wire having a stranded or braided construction to allow for displacement of the batteries 162 when the contour of the internal bore 1101 changes in response to bending tubular body 110.

A tubular body 110 with one or more bendable portions 112 provides the ability of the electronic simulated smoking device 100 to be formed by a user into a contour that at least partially encompasses a portion of the user's body so that it can be worn as an ornament or an accessory. Depending upon the length and/or diameter of tubular body 110, device 100 can be worn about such body portions as the neck, wrist, or finger, as examples. It is contemplated that anywhere a user wears ornamentation or accessories, device 100 can be configured to be similarly worn thereat.

As shown in FIG. 2, tubular body 110 may be reversibly bent into an annulus to encompass such bodily structures as a user's neck or wrist. The tubular body is maintained about the user using a releasable coupling 280 formed by complementary elements at the opposing end portions 1102 and 1104 of tubular member 110 and is releasably retainable thereat. End cap 170 is formed with an end portion 171 having a contour corresponding to an internal contour of the suction opening 126 of the mouthpiece portion 120 to be received therein. End cap 170 has a projection 172 extending therefrom with a locking head portion 174 at the distal end thereof. When the end portion 171 of end cap 170 is received in the suction opening 126, the projection 172 locates the locking head 174 so that it releasably lockingly engages the mouthpiece through opening 128. By this arrangement, the electronic simulated smoking device 100 can be conveniently carried by a user on the user's person; worn as a fashion accessory when not in use.

Figure 5:
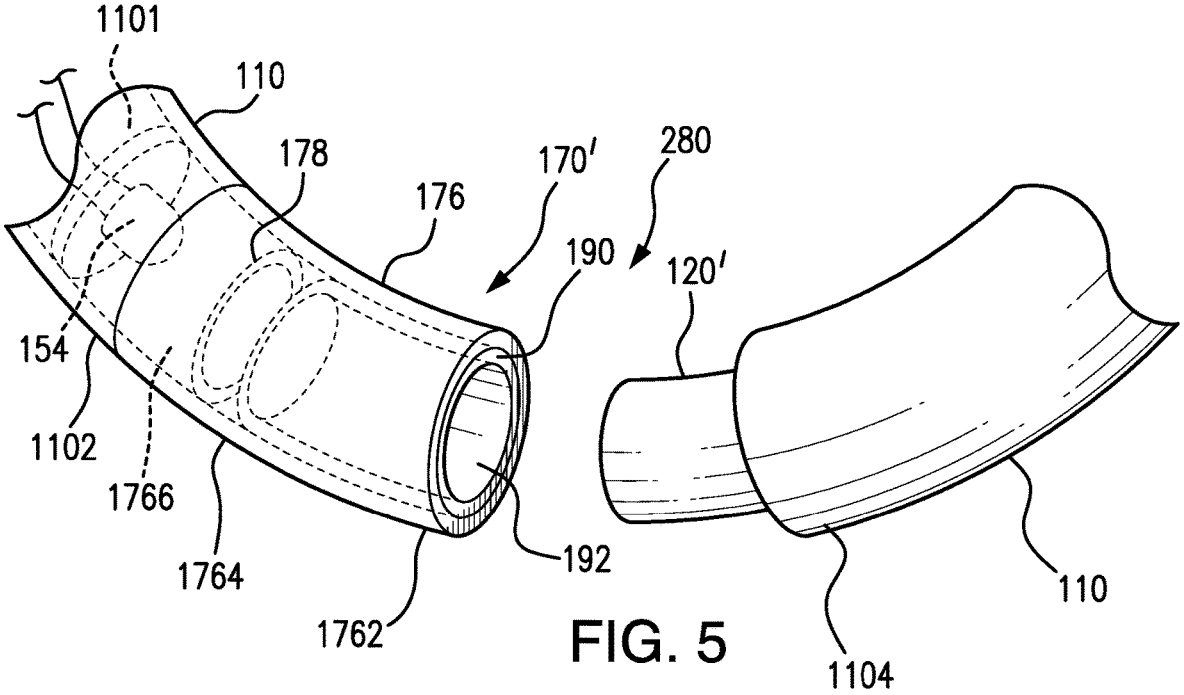
FIG. 5 is an enlarged partial view taken along the section line 5-5 in FIG. 2 showing an alternate coupling structure of the tubular body.

Other complementary elements at the opposing end portions 1102 and 1104 of tubular member 110 can be utilized to provide a releasable coupling 280 to maintain the tubular body 110 about a portion of the user's body. For example, as shown in FIG. 5, the proximal end 1104 of tubular body 110 may be coupled to a mouthpiece 120' formed of a metallic composition containing a ferrous metal. The opposing distal end 1102 of tubular body 110 is fitted with an end cap 170' formed by a light transmissive tubular member 176. The light transmissiveness of tubular member 176 can range from transparent to varying levels of translucency. Tubular member 176 is coupled to the distal end 1102 of tubular member 110 by means of a coupling sleeve 178 affixed within the internal bore 1101 of tubular member 110 and extending into the internal bore 1766 of tubular member 176 to be affixed thereat. Within the internal bore 1766 of tubular member 176 adjacent the receiving end 1762 there is disposed an annular magnet 190. Thus, the mouthpiece 120' is inserted into the opening 192 at the receiving end 1762 of tubular member 170' to be magnetically held thereat. A user is able to release the coupling of the distal end 1104 of tubular body 110 from the tubular member 176 by applying a sufficient tensile force therebetween to overcome the magnetic attraction between the annular magnet 190 and the metallic mouthpiece 120'. When device 100 is in use, illumination from LED 154 is emitted through the opening 192 and an illumination region 1764 located between a rear end of the annular magnet 190 and, at least, a tubular member facing end of the coupling sleeve 178. The illumination region 1764 may be expanded in size through the use of a coupling sleeve 178 formed of a light transmissive material.

Figure 6:
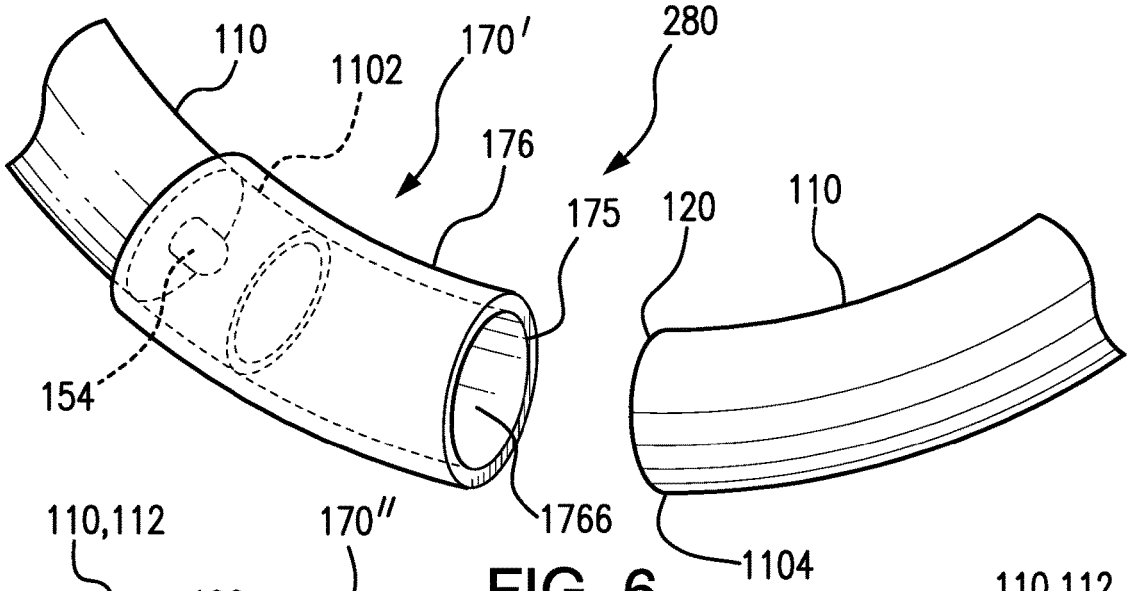
FIG. 6. is an enlarged partial view taken along the section line 6-6 in FIG. 2 showing another alternate coupling structure of the tubular body.

Another alternative arrangement of releasable coupling 280 is shown in FIG. 6. Here, the end cap 170' includes a tubular member 176 having an internal bore 1766 into which the distal end 1102 of the tubular body 110 is received and affixed thereat. As in the example of FIG. 5, tubular member 176 is formed of a material that has a light transmissiveness that can range from transparent to varying levels of translucency to emit illumination from the LED 154. The mouthpiece 120 portion of tubular body 110 at the proximal end 1104 thereof is insertable into the opening 175 to be received and frictionally engaged within the internal bore 1766 of the tubular member 176. A user is able to easily release the coupling of the distal end 1104 of tubular body 110 from the tubular member 176 by applying a sufficient tensile force therebetween to overcome the frictional engagement between the tubular member 176 and the mouthpiece 120.

Figure 7:
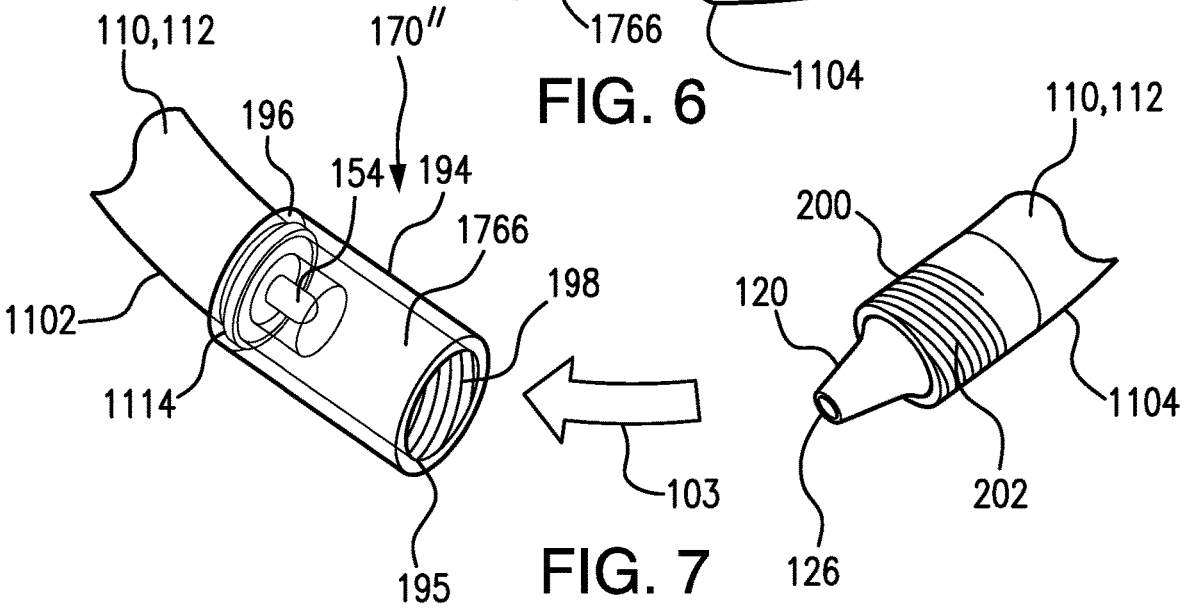
FIG. 7 is an enlarged partial view taken along the section line 7-7 in FIG. 2 showing a further alternate coupling structure of the tubular body.

A further alternative arrangement of releasable coupling 280 is shown in FIG. 7. The arrangement illustrated in FIG. 7 is particularly useful where the bendable portion 112 of tubular body 110 is formed of a metallic material. Here, an end cap 170" provides threaded releasable engagement with a connector 200 affixed to the proximal end 1104 of tubular member 110. End cap 170" includes a coupling 194 rotatably affixed to the distal end 1102 of tubular body 110. The proximal end 1104 of tubular body 110 is coupled to a connector 200 from which the mouthpiece 120 extends. Connector 200 has external threads 202 formed thereon.

The opposing distal end 1102 of tubular body 110 has a fixing ring 1114 affixed to, and circumscribing, the outer surface thereof. The end cap 170" is formed with an internal annular groove 196 into which the fixing ring 1114 is received to thereby establish a rotatable connection to the distal end 1102 of tubular body 110. End cap 170" is formed of a plastic material with a light transmissiveness ranging from transparent to varying levels of translucency to thereby emit illumination from the LED 154. The end cap 170" may be formed of a plastic material that is sufficiently elastic to permit the fixing ring 1114 to "snap" into the annular groove 196. Where a less elastic material is used, the end cap 170" may have two longitudinally separate halves that are assembled to the distal end 1102 of tubular body 110 and joined together thereat by any of a plurality of conventional means. Accordingly, to couple the opposing ends 1102 and 1104 of tubular body 110, the mouthpiece 120 is inserted into the internal bore 1766 of the end cap 170" through the opening 195, as indicated by directional arrow 103, and the end cap 170" is rotated to engage the internal threads 198 thereof with the external threads 202 of the connector 200. To uncouple the ends 1102 and 1104 of tubular body 110, the user simply rotates the end cap 170" in the opposite direction to thereby disengage the threaded connection.

Figure 8:
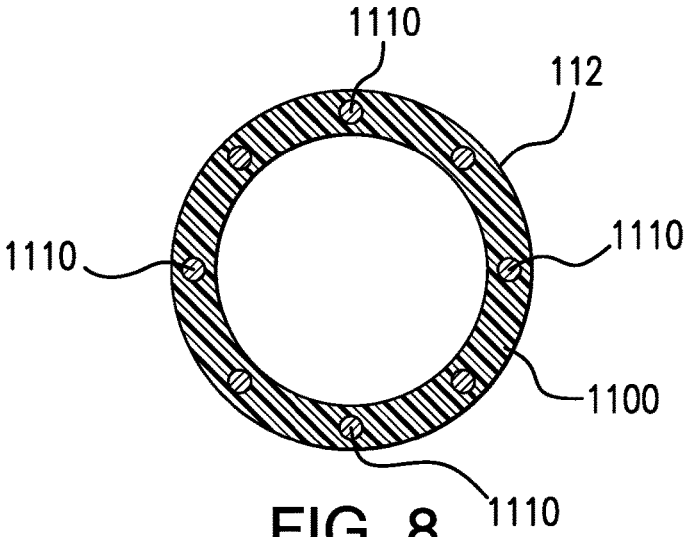
FIG. 8 is a cross-sectional view taken along the section line 8-8 of FIG. 2 showing a further alternate structure of the tubular body.

The bendable portion 112 of tubular body 110 may be formed of a variety of plastic or metallic materials and may encompass the entirety of tubular body 110. As shown in FIG. 8, the strength and/or elasticity of the bendable portion 112 of tubular body 110 may be improved by embedding a plurality of longitudinally extended wire members 1110 in the plastic wall 1100 to extend axially therein. The number, diameter, and material of wire members 1110 is selected as a function of the characteristics to be achieved.

Figure 3:
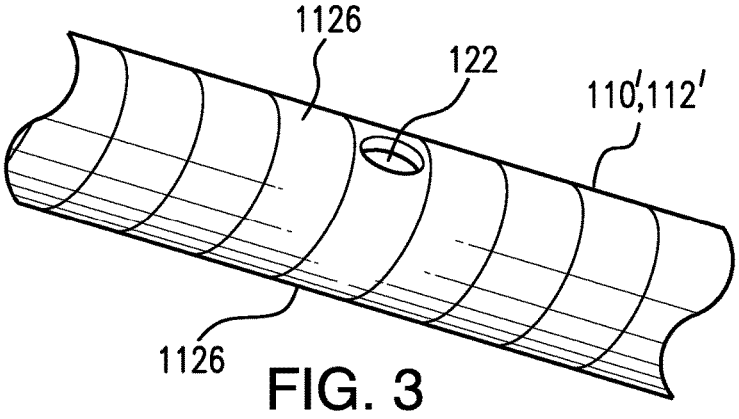
FIG. 3 is an enlarged partial view taken along the section line 3-3 in FIG. 2 showing an alternate structure of the tubular body.

Referring to FIG. 3, the wearable electronic simulated smoking device 100 may include a bendable portion 112' of a tubular body 110' formed of a metallic material where a strip of metal 1126 is helically wound in a partially overlapping manner to form the annular wall of the flexible tube. This type of construction is commonly referred to as a "gooseneck" tube or conduit. Where the "gooseneck" structure is being used, the air inlet opening 122 is formed through one of the metal strips 1126.

Figure 4:
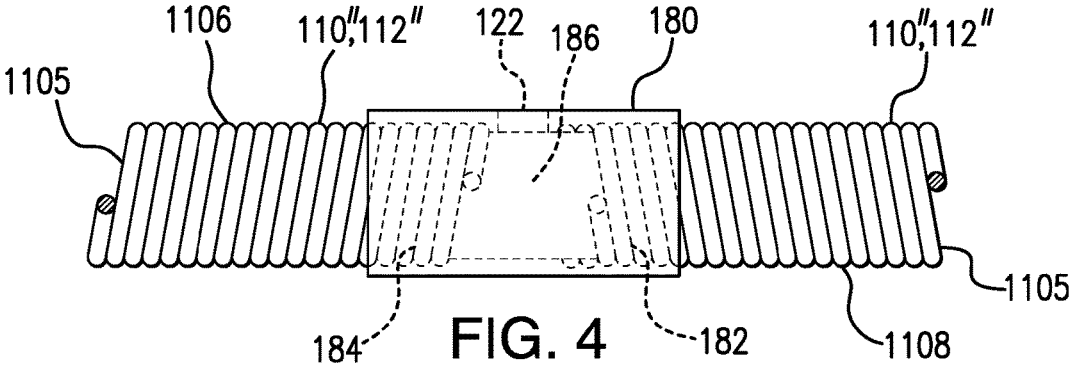
FIG. 4 is an enlarged partial view taken along the section line 4-4 in FIG. 2 showing an another alternate structure of the tubular body.

Another metallic construction is illustrated in FIG. 4. Here, the wearable electronic simulated smoking device 100 has bendable portions 112" of a tubular body 110" formed of at least two helical springs 1106 and 1108. Each spring 1106, 1108 when oriented for use of the device 100 is unbent and each spring has sufficient bias force between the helical turns of the wire 1105 to be substantially impervious to air when a user inhales through the tubular body 110". The two springs 1106 and 1108 are joined by an inlet connector 180. Inlet connector 180 has a cylindrical tubular contour with a through bore 186. The air inlet opening 122 is formed through the wall of inlet connector 180 and is in open communication with the through bore 186. Opposing ends of through bore 186 each have internal threads 182 and 184 into which the helically wound wire 1105 of the springs 1108 and 1106 are respectively threadedly engaged. The internal threads 184 may be right hand threads and the internal threads 186 may be left hand threads. The springs 1106 and 1108 are correspondingly wound (opposite to one another) so that both springs are simultaneously threadedly engaged responsive to rotation of the inlet connector 180 being rotated in one direction relative to both springs 1106 and 1108, as is done with a turnbuckle. Other methods of securing the inlet connector 180 to springs 1106 and 1108, such as adhesive bonding, welding, swaging, and the like may alternately be used. Similar methods may be employed to join the mouthpiece connector and end cap to the free ends of the springs 1106 and 1108.

Figure 1:
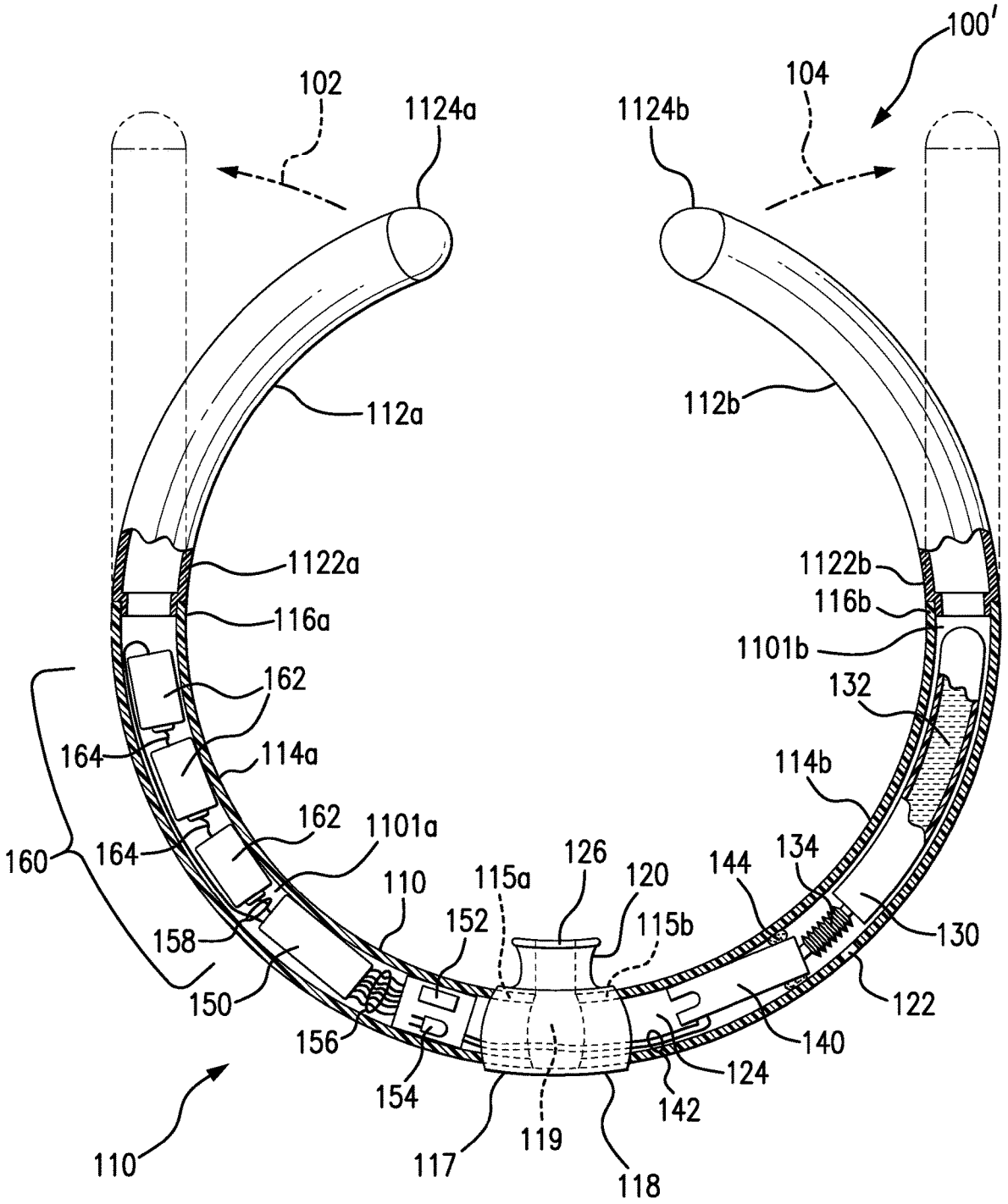
FIG. 1 is a schematic illustration, partially cut-away, of a configuration of the present invention.

Turning now to FIG. 1, there is shown a wearable electronic simulated smoking device 100' that has a configuration where at least a portion of the tubular body 110 has a fixed contour and at least another portion is bendable to change the contour thereof. The wearable electronic simulated smoking device 100' has a tubular body formed by bendable portions 112*a*, 112*b* and the portions 114*a*, 114*b* having a fixed arcuate contour. The fixed contour portions 114*a*, 114*b* may be formed of plastic or metallic materials, as can the bendable portions 112*a*, 112*b*, which bendable portions may be formed of materials and structures as previously described in preceding paragraphs. By that arrangement, the device 100' is able to at least partially encompass a portion of the user's body and be releasably retainable thereat to thereby provide both the electronic smoking function as well as serve as a fashionable ornament or accessory.

The operational components of wearable electronic simulated smoking device 100' are distributed within the internal bore 1101*a*, 1101*b* of the tubular portions 114*a* and 114*b*. The portions 114*a* and 114*b* are joined by a mouthpiece connector 118 that has a connector body 117 from which the mouthpiece 120 extends. Within the internal bore 1101*b* of arcuate portion 114*b* there is disposed a fluid container 130 with a supply of a liquid smoking composition 132 therein. The fluid container 130 is fluidly coupled to a nebulization chamber 140 by a flexible conduit 134. Nebulization chamber 140 is disposed in the fluid flow path 124 that extends from the air inlet opening 122, through the through bore 119 of mouthpiece connector 118, to the suction opening 126. As previously described, nebulization chamber 140 is provided with air inlet openings on a rear portion thereof (not shown) to allow air to be drawn therethrough. An annular seal 144 encompasses the nebulization chamber 140 to block air from bypassing passage through nebulization chamber 140. The descriptions of the components 130, 132, 134, and 140 and alternatives thereto apply to device 100' as well.

Within the internal bore 1101*a* of arcuate portion 114*a* there is disposed a sensor 152 in open fluid communication with the fluid flow path 124 for detecting a reduction in air pressure in fluid flow path 124 as an indication of a user drawing in air from the suction opening 126 of mouthpiece 120. Also in proximity to the fluid flow path 124 is an LED 154, which is illuminated when the sensor detects a user's inhalation and operation of the nebulization chamber 140 is initiated. The sensor 152 and LED 154 are connected to a controller 150 via corresponding pairs of a plurality of electrical wires 156. The controller 150 is provided to control the operation of the nebulization chamber 140 in response to inhalation by a user, as was described in preceding paragraphs and thus not repeated here. To enable the energization of the nebulization chamber 140 and LED 154, a power supply 160 is connected to controller 150 by means of a pair of electrical wires 158. Power supply 160 is formed by a plurality of batteries or cells 162 that may be connected in series, parallel, or a combination of series and parallel by means of one or more interconnection leads 164, as appropriate to the battery connection arrangement. Each interconnection lead 164 is a flexible electrical wire having a stranded or braided construction.

The mouthpiece connector 118 may be formed of a plastic material with a light transmissiveness ranging from transparent to varying levels of translucency to thereby emit illumination from the LED 154. Alternately, mouthpiece connector 118 may be formed of a metallic material with a light transmissive plastic insert incorporated therein to permit visualization of illumination from LED 154. The proximal end 115*a* of the arcuate portion 114*a* of tubular member 110 is received into the through bore 119 of the connector body 117 of mouthpiece connector 118 from one side thereof, and the proximal end 115*b* of arcuate portion 114*b* of tubular member 110 is likewise received into the through bore 119 from the opposing side of connector body 117. By that arrangement, the through bore 119 and the suction opening 126 therewith are placed in open communication with the fluid flow path 124 and the internal bore 1101*a* of the arcuate portion 114*a* of tubular member 110 so that the sensor 152 is able to sense air pressure changes in fluid flow path 124.

Figure 9:
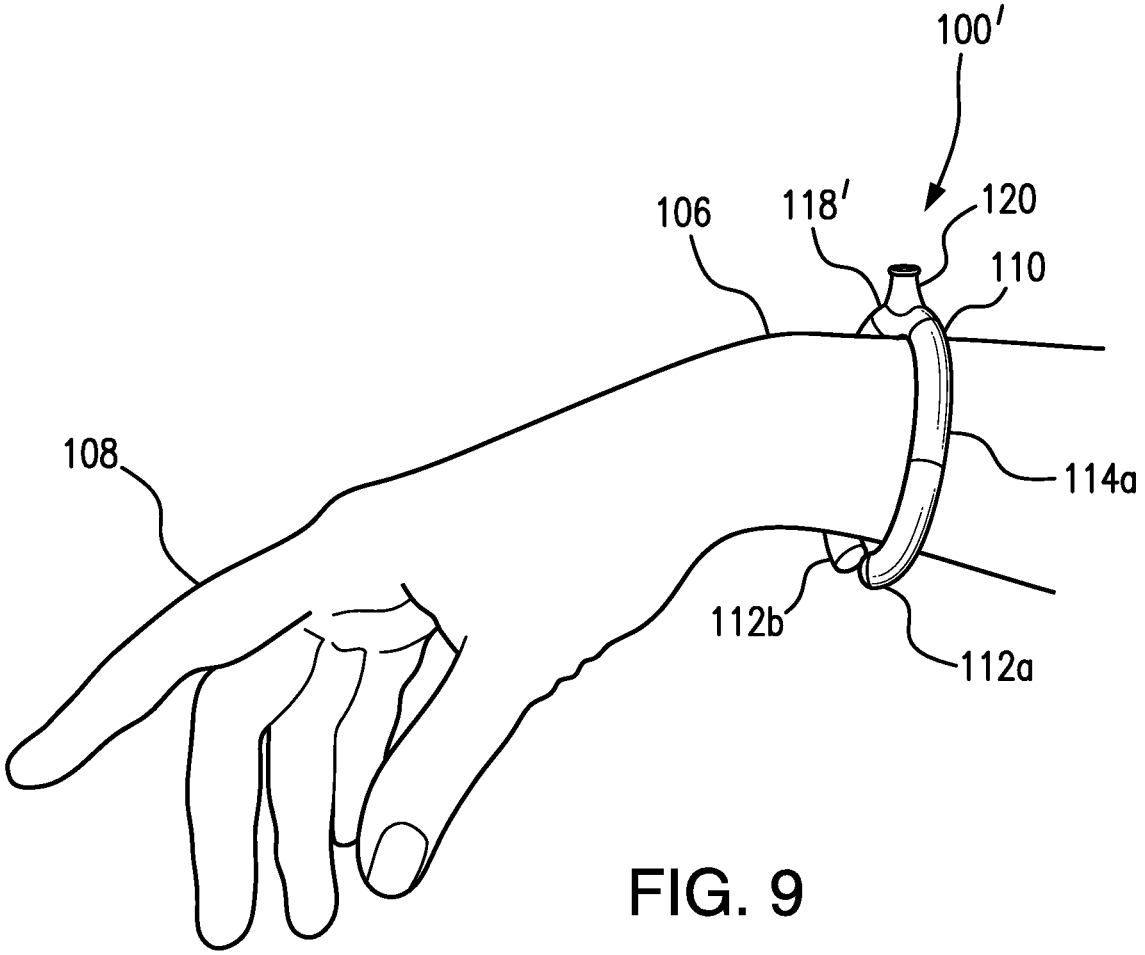
FIG. 9 is an illustration of a modification of the configuration shown in FIG. 1 to be worn on a user's wrist.

The mouthpiece 120 extending from the connector body 117 may be disposed at any angle relative to the plane established by the tubular body 110. When the electronic simulated smoking device 100' is to be worn about a user's neck, the angle of the mouthpiece 120 relative to the plane established by tubular body 110 is desirable to be within a range of 0 degrees, as illustrated in FIG. 1, to 180 degrees. If the diameter of the arcuate contour of the tubular body 110 is sufficiently large, the wearable electronic simulated smoking device 100' can conveniently be used without removal from the user's neck for an orientation of mouthpiece 120 relative to the plane established by tubular body 110 within a range of 0 degrees to 90 degrees. With reference to FIG. 9, when electronic simulated smoking device 100' is sized to be worn around a user's wrist 106 or finger 108, the angle of the mouthpiece 120 relative to the plane established by tubular body 110 is desirable to be within a range of 90 degrees to 270 degrees. A most convenient orientation for mouthpiece 120 in that application is at a substantially 180 degree angle, extending from the convex side of the arcuate contour of the tubular body 110.

Referring to both FIGS. 1 and 9, the bendable portions 112*a* and 112*b* respectively extend from the distal ends 116*a* and 116*b* of the arcuate portions 114*a* and 114*b*. Each of the bendable portions 112*a*, 112*b* have a proximal end 1122*a*, 1122*b* secured to the distal end 116*a*, 116*b* of the corresponding arcuate portion 114*a*, 114*b*. Each bendable portion 112*a*, 112*b* has a closed distal end 1124*a*, 1124*b*. The bendable portions 112*a* and 112*b* may be formed of the same materials and/or structure as the bendable portion of electronic simulated smoking device 100 discussed in preceding paragraphs. Accordingly, when a user wishes to encompass a portion of their body, such as their neck, wrist or finger, with the electronic simulated smoking device 100', the user bends the portions 112*a* and 112*b* outwardly, as indicated by direction arrows 102 and 104, and passes the tubular body 110 around the selected portion of the user's body. Once positioned, the user either releases the bendable portions 112*a* and 112*b* to return to their original arcuate contour and at least partially encompass the selected portion of the user's body, when bendable portions 112*a* and 112*b* have an elastic property, or manually bend the bendable portions 112*a* and 112*b* back into an arcuate contour sufficient to at least partially encompass the selected portion of the user's body and maintain the electronic simulated smoking device 100' thereat.

Figure 10:
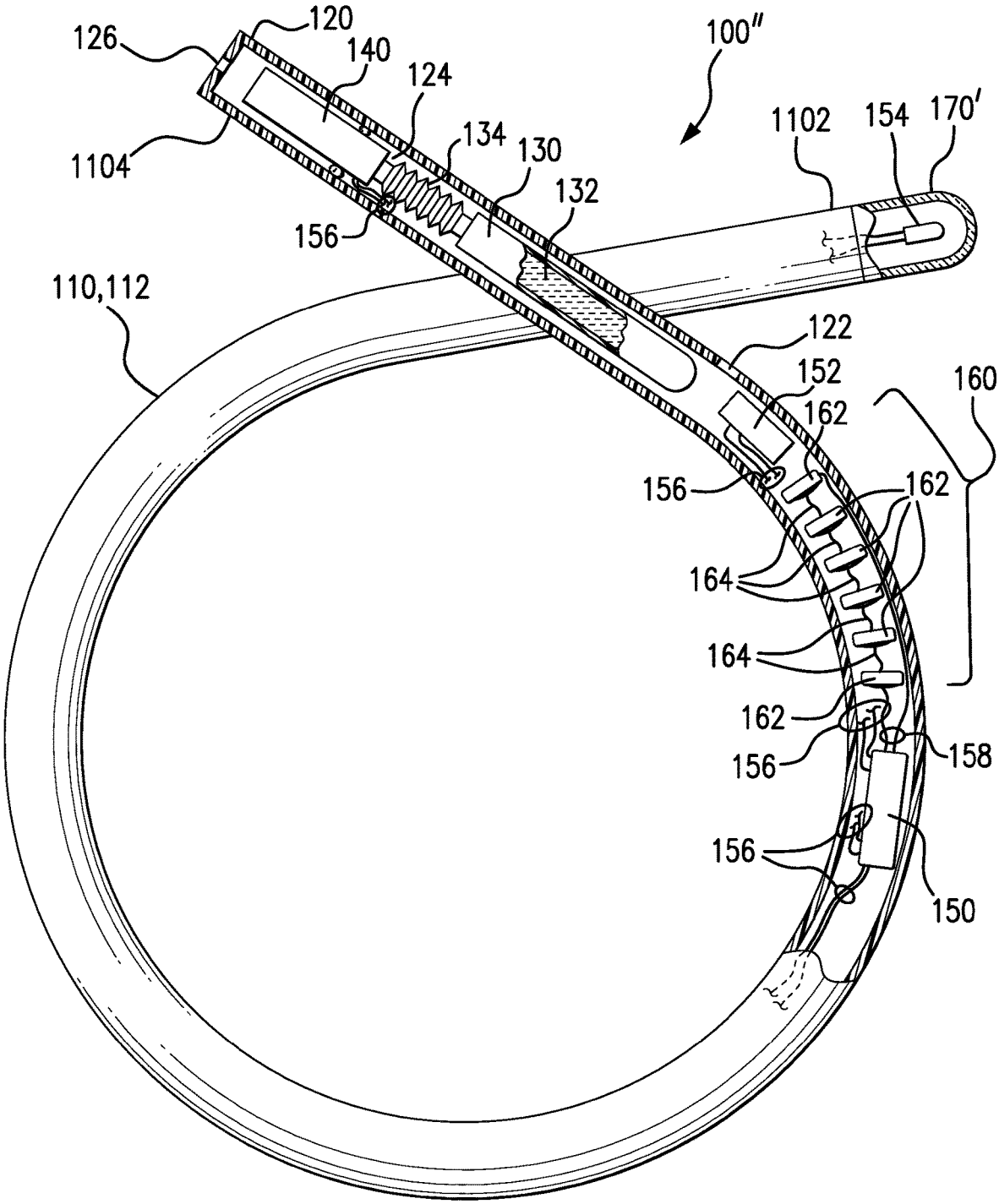
FIG. 10 is a schematic illustration, partially cut-away, of a further configuration of the present invention in a bent contour.
Figure 11:
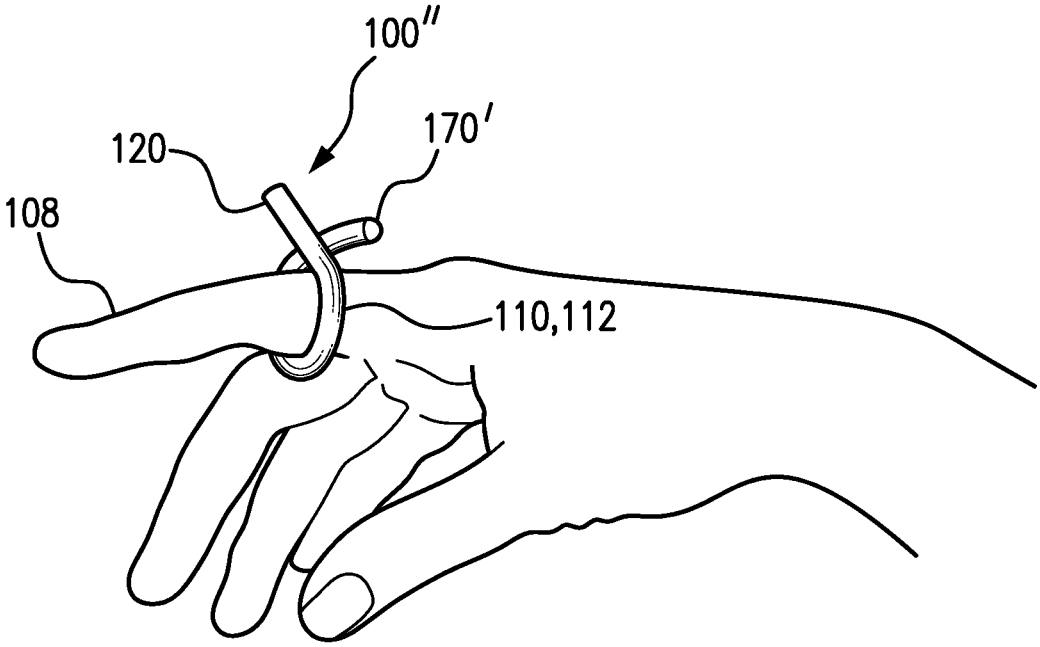
FIG. 11 is an illustration of the configuration shown in FIG. 10 being worn on a user's finger.
Figure 12:
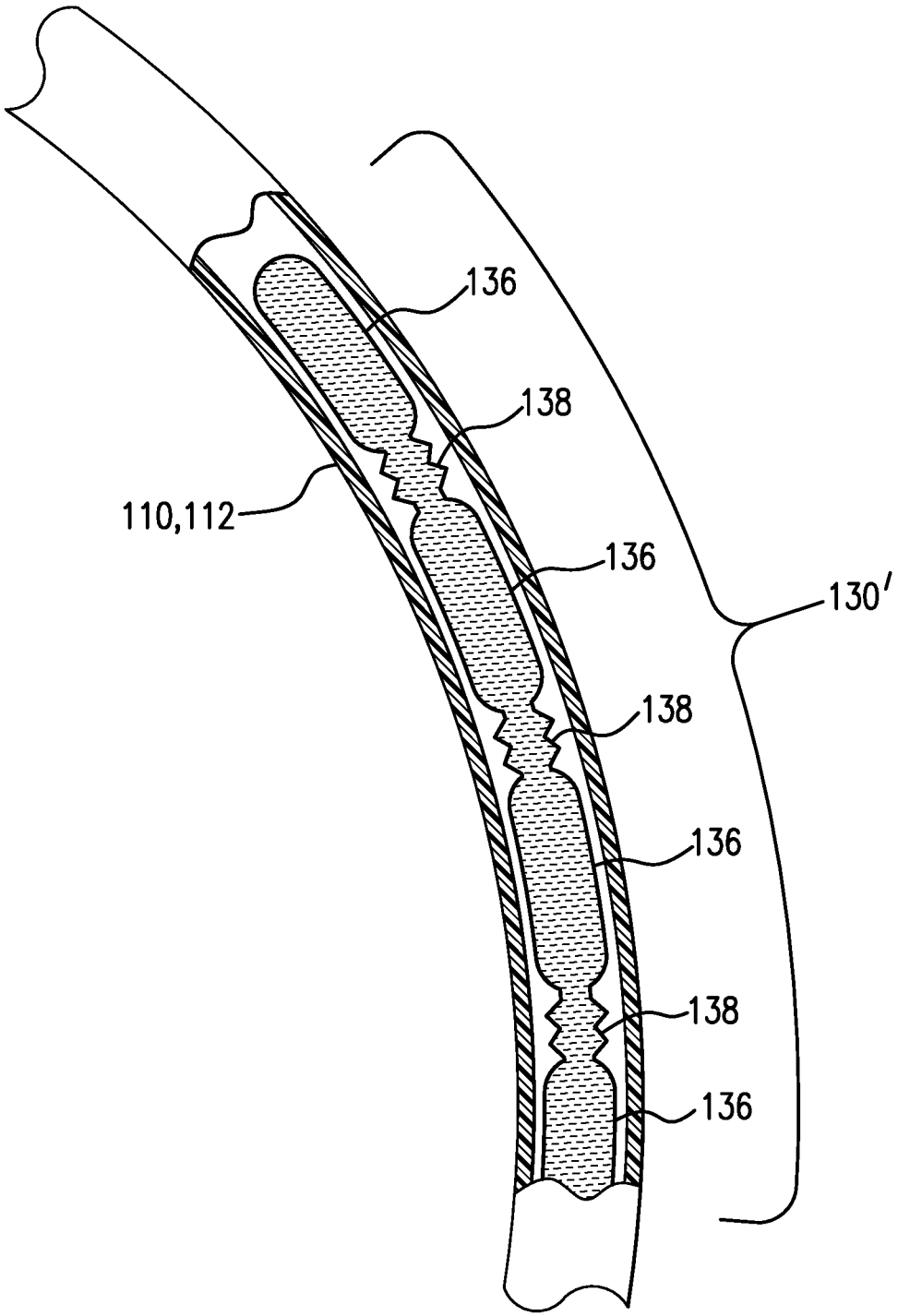
FIG. 12 is a sectional view taken along the section line 12-12 in FIG. 2 showing an alternate liquid container arrangement.

Turning now to FIGS. 10 and 11, there is shown wearable electronic simulated smoking device 100". The electronic simulated smoking device 100" is structurally identical to electronic simulated smoking device 100, previously described, but with a tubular body 110 that is elongated to a greater extent than would be the case for device 100 for use with the same selected portion of the user's body, and without the components that form the releasable coupling 280. Hence, a light transmissive end cap 170' is coupled to the distal end 1102 of tubular body 110 and a mouthpiece 120 is provided at the opposing end 1104. The extended length of tubular body 110 and the bendable portion 112 therewith, the bendable portion 112 being essentially coextensive with the entire tubular body 110, permits a user to wrap the tubular body 110 to form a closed loop about selected portions of the user's body and thereby is releasably retainable thereat. Thus, the tubular body 110 is able to fully encompass exemplary selected portions of the user's body as the neck, wrist or finger. As an example of the application of electronic simulated smoking device 100", FIG. 11 shows the device 100" being worn about a user's finger 108. As the releasable coupling is not required to retain the tubular body 110 about the user's finger 108, the user is able to easily access the mouthpiece 120 without the necessity of removing it from their finger.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features. In certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A wearable electronic simulated smoking device, comprising:

an elongated tubular body having at least a portion thereof being reversibly bendable for said tubular body to form an arcuate shape at least partially encompassing a portion of a user's body, said tubular body having an air inlet formed therein, a suction opening, and a fluid flow path therebetween within an internal bore of said tubular body;

a vaporization chamber disposed in said internal bore of said tubular body for vaporizing a vaporizable smoking composition, said vaporization chamber being in communication with said fluid flow path;

a controller disposed in said internal bore of said tubular body and being coupled to said vaporization chamber for activating said vaporization chamber to generate vapor from the vaporizable smoking composition and add said vapor to air drawn through said fluid flow path; and a power supply disposed in said internal bore of said tubular body and being coupled to said controller.

2. The wearable electronic simulated smoking device as recited in claim 1, further comprising a reservoir disposed in said internal bore of said tubular body, said reservoir having a quantity of the vaporizable smoking composition disposed therein for supply to said vaporization chamber, said reservoir being formed of a plurality of chambers disposed in spaced relationship and fluidly connected in series by respective flexible container conduits to accommodate changes to an interior space of said bendable portion by reversible bending thereof into said arcuate shape.

3. The wearable electronic simulated smoking device as recited in claim 1, where said bendable portion of said tubular body has an annular wall formed of a flexible material.

4. The wearable electronic simulated smoking device as recited in claim 3, where said flexible material of said annular wall is a plastic composition.

5. The wearable electronic simulated smoking device as recited in claim 4, where said annular wall of said portion of said tubular body has a plurality of longitudinally extended wire members embedded in said plastic composition.

6. The wearable electronic simulated smoking device as recited in claim 1, where said bendable portion of said tubular body has an annular wall formed to define a flexible structure.

7. The wearable electronic simulated smoking device as recited in claim 6, where said flexible structure is a gooseneck structure.

8. The wearable electronic simulated smoking device as recited in claim 6, where said flexible structure is a helical spring structure.

9. The wearable electronic simulated smoking device as recited in claim 1, where said tubular body has a pair of opposing ends releasably coupleable one to the other.

10. The wearable electronic simulated smoking device as recited in claim 1, where said suction opening is formed in a mouthpiece member coupled to said tubular body.

11. The wearable electronic simulated smoking device as recited in claim 10, where said mouthpiece member is formed of a light transmissive material for viewing illumination from an indicator located in said internal bore of said tubular body.

12. The wearable electronic simulated smoking device as recited in claim 1, where said vaporization chamber is sufficiently smaller in diameter than said internal bore of said tubular body to be accommodated therein when said tubular body is bent in an arcuate contour.

13. The wearable electronic simulated smoking device as recited in claim 1, where said power supply is formed by a plurality of battery cells each being individually displaceable, one with respect to another, to accommodate changes to an interior space of said bendable portion by reversible bending thereof.

14. A wearable electronic simulated smoking device, comprising:

an elongated tubular body being reversibly bendable into an arcuate shape at least partially encompassing a portion of a user's body, said tubular body having an air inlet formed therein, a suction opening, and a fluid flow path therebetween within an internal bore of said reversibly bendable tubular body;

a vaporization chamber disposed in said internal bore of said tubular body for vaporizing a vaporizable smoking composition, said vaporization chamber being in communication with said fluid flow path;

a controller disposed in said internal bore of said tubular body and being coupled to said vaporization chamber for activating said vaporization chamber to generate vapor from the vaporizable smoking composition and add said vapor to air drawn through said fluid flow path; and a power supply disposed in said internal bore of said tubular body and being coupled to said controller.

15. The wearable electronic simulated smoking device as recited in claim 14, further comprising a reservoir disposed in said internal bore of said reversibly bendable tubular body, said reservoir having a quantity of the vaporizable smoking composition disposed therein for supply to said vaporization chamber, said reservoir being formed of a plurality of chambers disposed in spaced relationship and fluidly connected in series by respective flexible container conduits to accommodate changes in an interior space of said internal bore by reversible bending of said tubular body into said arcuate shape.

16. The wearable electronic simulated smoking device as recited in claim 14, where said tubular body has an annular wall formed of a flexible material.

17. The wearable electronic simulated smoking device as recited in claim 16, where said flexible material of said annular wall is a plastic composition.

18. The wearable electronic simulated smoking device as recited in claim 17, where said annular wall of said tubular body has a plurality of longitudinally extended wire members embedded in said plastic composition.

19. The wearable electronic simulated smoking device as recited in claim 14, where said tubular body has an annular wall formed to define a flexible structure.

20. The wearable electronic simulated smoking device as recited in claim 19, where said flexible structure is a gooseneck structure.

21. The wearable electronic simulated smoking device as recited in claim 19, where said flexible structure is a helical spring structure.

22. The wearable electronic simulated smoking device as recited in claim 14, where said tubular body includes a portion thereof formed of a light transmissive material for viewing illumination from an indicator located in said internal bore of said tubular body.

23. The wearable electronic simulated smoking device as recited in claim 14, where said suction opening is formed in a mouthpiece member coupled to said tubular body.

24. The wearable electronic simulated smoking device as recited in claim 14, where said vaporization chamber is sufficiently smaller in diameter than said internal bore of said tubular body to be accommodated therein when said tubular body is bent in an arcuate contour.

25. The wearable electronic simulated smoking device as recited in claim 14, where said power supply is formed by a plurality of battery cells each being individually displaceable, one with respect to another, to accommodate changes to an interior space of said bendable portion by reversible bending thereof.

* * * * *